United States Patent [19]

Patxot

[11] 4,247,295

[45] Jan. 27, 1981

[54] DISCHARGE PRINTING OF TEXTILES DYED WITH INDIGO BLUE

[75] Inventor: Francisco J. Patxot, Badalona, Spain

[73] Assignee: Estampados Estil, S.A., Badalona, Spain

[21] Appl. No.: 134,224

[22] Filed: Mar. 26, 1980

Related U.S. Application Data

[63] Continuation-in-part of Ser. No. 45,747, Jun. 5, 1979, abandoned.

[30] Foreign Application Priority Data

May 14, 1979 [ES] Spain ..... 480.522

[51] Int. Cl.[3] ..... D06P 5/15

[52] U.S. Cl. ..... 8/465; 8/589; 8/590

[58] Field of Search ..... 8/465, 589

[56] References Cited

U.S. PATENT DOCUMENTS

| | | | |
|---|---|---|---|
| 2,004,476 | 10/1931 | Barz et al. | 8/69 |
| 2,164,930 | 11/1937 | Lubs | 8/69 |
| 2,205,887 | 6/1938 | Kern | 8/69 |
| 2,420,336 | 5/1947 | Orchard | 8/69 |
| 2,759,975 | 8/1956 | Chiddix et al. | 8/69 |
| 2,874,022 | 2/1959 | Raff et al. | 8/69 |
| 3,097,045 | 7/1963 | Bartl et al. | 8/69 |
| 3,591,325 | 7/1971 | Sapers | 8/69 |

OTHER PUBLICATIONS

Chem. Abstract 83:180972p 1975.

*Primary Examiner*—Joseph L. Schofer
*Assistant Examiner*—Maria S. Tungol
*Attorney, Agent, or Firm*—Haseltine, Lake & Waters

[57] ABSTRACT

The discharge printing past contains the sodium or calcium salt of a sulfonated derivative of an N-alkylated benzylphenyl ammonium halide which acts as a sequestering and solubilizing agent for the indigo blue. It is used in conjunction with a reducing agent (or an oxidizing agent) and a bleaching agent or process resistant dye, depending on whether the print is to be white or colored. After developing in the presence of a second removing agent and a strong dispersing agent, the textile stock is washed, dried, subjected to conventional finishing treatments and again dried.

3 Claims, No Drawings

DISCHARGE PRINTING OF TEXTILES DYED WITH INDIGO BLUE

CROSS-REFERENCE TO RELATED APPLICATION

This is a continuation-in-part application of Ser. No. 45,747 filed June 5, 1979 now abandoned.

BACKGROUND OF THE INVENTION

This invention relates to a discharge printing procedure on textile stock dyed with indigo blue. This procedure will no doubt revolutionize the textile industry since, to date, it has not been possible to achieve a quality printing on fabrics previously dyed with indigo blue.

One of the basic features of textile stock dyed with indigo blue relates to the degree of setting obtained with this dyestuff. This setting causes problems which have been impossible to solve to date when one wished to achieve a high quality print on fabrics dyed in this way. Up to the present the only achievement has been that of overprinting, i.e. to print the pattern desired over the indigo blue which deteriorated the quality of the print completely. This print disappeared very easily and therefore it was not possible to apply this process to high quality articles.

With the procedure of the present application it is possible to obtain a print with the quality desired, even better than that of the indigo blue dyeing itself and therefore the introduction of the said process is bound to cause a revolution within the textile industry.

With the discharge printing procedure claimed herein, one can achieve perfectly localized discharge effects in the form of fancy patterns on a conventional or knitted fabric previously dyed with indigo blue. This fabric may be dyed only in the warp, only in the weft or on all the yarns. This process can also be applied to non-woven laps, to knitted fabrics or even non-wovens.

The effects of discharge printing can be seen both in patterns in which the basic fabric color normally white or ivory appears and also in colored effects. The number of colors which can be applied is infinite and the geometric form of the patterns is very varied as is also their position on the textile stock.

Furthermore this discharge printing method can be applied to any type of textile fiber which is suitable for dyeing with indigo blue and also to conventional fabrics with any kind of texture and features and to knitted fabrics produced by any kind of knitting method.

The discharge printing procedure to be described here can be applied using any existing printing installation i.e. continuous, discontinuous or jumper.

It is also worthwhile to mention that with this process the initial strength of the fibers or yarns making up the fabrics can be maintained. However, if one needs to change the strength, the process would be adapted to allow this to be done.

Regarding the fastness to washing of the coloring effects achieved by the process claimed herein, this can also be regulated in accordance with any of the degrees of fastness from high to low. Therefore it is quite feasible for the print to have a higher, lower or even the same fastness as the indigo blue dye.

Once the textile stock dyed with indigo blue has been discharge printed, the later finishing stages such as raising, finishing, grinding, ageing can be carried out as well as the application of special chemical finishes such as creaseless finish, unshrinkable finish, maté finish, shiny finish or any other kind of finishing process which may be applied to fabric which has been dyed only with indigo blue.

SUMMARY OF THE INVENTION

The discharge printing paste used for indigo blue dyed textiles according to the invention contains the sodium or calcium salt of a sulfonated derivative of an N-alkylated benzylphenyl ammonium halide which acts as a sequestering and solubilizing agent for the indigo blue. It is used in conjunction with a reducing agent (or an oxidizing agent) and a bleaching agent or process resistant dye, depending on whether the print is to be white or colored. After developing in the presence of a second removing agent and a strong dispersing agent, the textile stock is washed, dried, subjected to conventional finishing treatments and again dried.

DETAILED DESCRIPTION

To obtain the required printing on textile stock previously dyed with indigo blue the process described below must be followed:

1. The textile stock, which may be woven fabric, yarn or knitted fabric, has previously been subjected to the operations necessary to prepare it for dyeing treatments by means of an indigo blue solution, which has the following composition as its initial formula:

1 kg of indigo blue dye
60 liters of water
2 liters of caustic sode (NaOH) at 38° Baumé
1½ kg of sodium hydrosulfite ($Na_2S_2O_4$).

This mixture is prepared in a beck keeping the temperature at 80° C. for half an hour, which allows the reducing effect necessary to take place on the dye to help it to dissolve, when it acquires a characteristic yellow tinge.

Once the mixture has been prepared in this way it is transferred to the dyebath, known as a color trough, which is located in installations which nowadays usually work on a continuous cycle. The dyebath can be topped up during the cycle by using solutions with 0.5 g/l of NaOH and 0.1 g/l of $Na_2S_2O_4$ with the amount of dye necessary to maintain a dye intensity of between 4 and 7% by weight of the textile stock. This solution will contain the necessary auxiliary products for the stabilization of the bath and its correct humidification.

Once the dyeing operation has been carried out, if this was done on yarn, this yarn is then woven to constitute the fabric in the true sense of the word and if the dyeing process was already carried out on woven fabric or on knitted fabric these are then sent to the next stage in the process, after washing and drying the textile stock.

2. Printing. It is at this stage where the process of the present invention begins specifically as all the previous stages are common to any kind of products which one wishes to dye with indigo blue.

The discharge printing procedure asserted here can be carried out as stated above on any type of printing installation in existence at the moment. The only difference is the process used.

The printing can be done using two different methods, either the reduction process or the oxidation process.

The procedure using the reduction process is given below.

To discharge print on textile stock dyed with indigo blue using the reduction process a printing paste must be prepared using the following basic products in the proportions per kilo of paste indicated.

Enough water to make up the solution to 1000 g.
Between 12 and 50% thickener
50 to 280 g sodium hydrosulfite
Bleaching agent or process resistant dye: 17 to 55 g.
Indigo dyestuff remover, which acts as a sequestering and solubilizing agent for indigo blue 7 to 43 g.

The thickener used may be dextrinated starch or etherized starch. For the indigo dyestuff remover, products of a quaternary nature are used, such as the sodium and calcium salts of the sulfonated derivatives of N-alkylated phenylbenzyl ammonium halide compounds. The preferred quaternary compound is dimethylphenylbenzyl ammonium chloride disodium sulfonate of the formula:

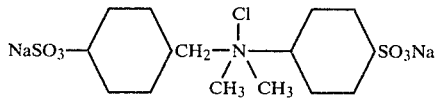

This compound may be prepared by sulfonation of dimethylbenzylphenyl ammonium chloride e.g., with sulfuric acid followed by neutralization e.g., with caustic soda.

A conventional bleaching agent should be added when the print is to be made in white. Otherwise the required dye from among those resistant to this type of process should be used.

Once the paste has been applied to the fabric dyed with indigo blue the fabric is put inside a drying oven while the setting process by means of drying and vaporization up to temperatures of 160° is carried out. It is recommended that the working temperature be between 100° and 126° C.

The textile stock is then removed to a bath in which it is allowed to develop by virtue of the presence of sodium hydroxide (NaOH) which hot-works without reaching the boiling point and acts as a removing agent, its proportion being 8 to 19 g per liter, in the presence of a strong dispersing agent in a solution of 5 to 17 g per liter. The preferred dispersing agents are sodium dimethylmethylate, $(CH_3)_2$ CHONa, and sodium dimethylmethanesulfonate, $(CH_3)_2CHSO_3Na$.

The latter compound is preferred because of its greater stability. Other dispersing agents may be used as long as they fulfill the following conditions:

1. They are compatible with the other chemical compounds which compose the developing bath (solution).
2. They do not attack nor degrade the background color, that is to say, the indigo blue on the non-discharged portions.

These dispersing agents act as assistants, helping to obtain cleaner and more accurate color patterns, but they do not constitute the gist of the invention.

Once this process is finished, the textile stock is washed with a plentiful supply of water using conventional detergents and emulsifying agents and then it is dried and given the usual finishing treatments, whereupon it is subjected to a drying process which is the last stage in the total process.

It is important to point out, that the specific features of the process, which are fundamental to the invention, are the presence of a remover in the printing paste, the object of which is to increase its aggressiveness and which tends to achieve a more intense elimination of the indigo blue, together with the presence of a strong dispersing agent in the later developing bath.

The chemistry involved in the discharge operation using the reduction method is as follows:

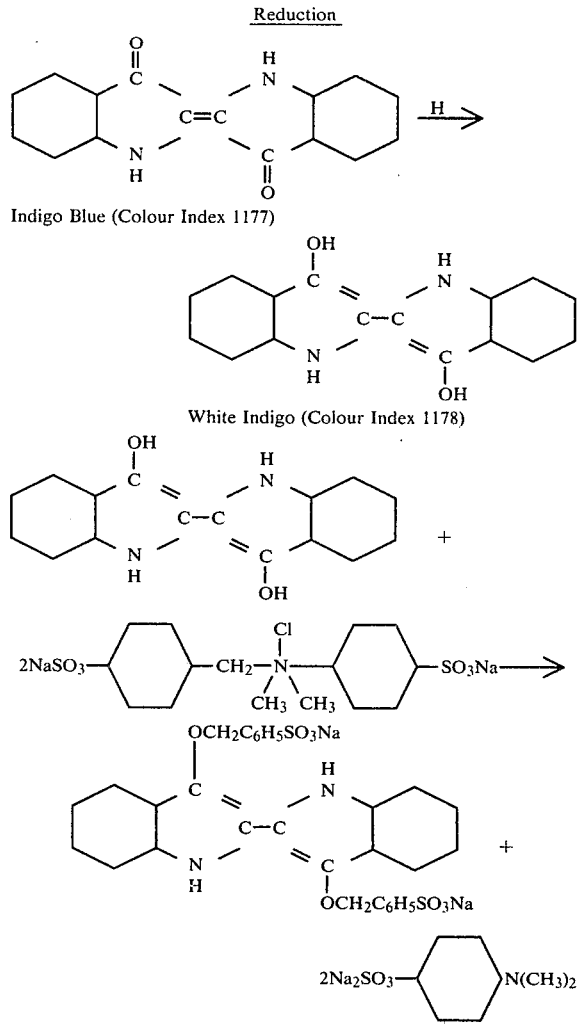

The discharge operation can also be carried out by the oxidation process, in which the first part of the procedure, i.e. the application of the printing paste onto the textile stock, is carried out in a similar way to the previous method, but substituting for the chemical reducing agent sodium hydrosulphite, the oxidizing agent sodium dichromate with caustic soda. The new formula for the paste is thus as follows:

Enough water to make the solution up to 1000 g.
Between 12 and 50% thickener.
Between 15 and 46 g of sodium dichromate.
Between 6 and 13 g of caustic soda.
Bleaching agent or process resistant dye 15 to 60 g.
Indigo dyestuff remover 7 to 43 g.

Using the oxidation method, the compound known as isatin having the formula:

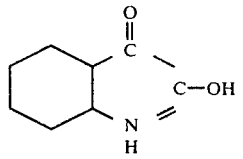

is formed by oxidation of the indigo. The quaternary ammonium halide sulfonate also appears to attack the hydrogen of the OH alcohol group, increasing the discharge reaction on the indigo blue. This sulfonate also protects the textile fiber from the dange of over-oxidation by the oxidizing agent, which could cause a drop in the mechanical resistance of the fabric in the discharge areas.

The thickener used should preferably be etherized starch and the remover will be the same as the one stated in the previous formulation.

The product will then be dried in suitable drying installations, be vaporized at between 100° and 126° in exactly the same way as in the previous method. The developing bath, however, will be completely different in that the removing agent is a mixture of oxalic acid and sulfuric acid at a temperature of between 35° and 55°, being in a solution in the proportion of between 34 and 70 g of sulfuric acid at 66° Bé and 30–60 g of oxalic acid per liter, accompanied by an energetic dispersing agent of the same features as that which appears in the reducing method.

The process is then finished with the same washing, finishing and drying processes as were stated in the reducing method.

By increasing the concentrations of acid in the paste and the temperature in the drying installation, the initial strength to the fibers or yarns making up the fabrics can be changed. This strength may be kept the same by merely reducing the temperature and the acid concentration to the level stated.

To adjust the fastness to washing of the coloring effects obtained, the conditions of setting must be changed, especially the temperature and the moisture content in the vaporizer. If we vary these, we can also vary and control the fastness, which will increase when the temperature and moisture contents are increased and vice versa.

The textile stock dyed with indigo blue and then discharge printed using the procedure described herein not only has a visible, very attractive, high quality finish, but also a gentle feel, the same as the stock had previous to being treated in this manner. This is not what occurs with stock dyed with indigo blue which are overprinted, in which the feel is much worse as in the printed areas the thickness is increased since a layer has been superposed. This is completely different to what happens in the process claimed herein, in which the thickness of the textile stock is the same all over the surface and it is not possible to notice the printed areas by feel.

Anything which does not affect, alter, change or modify the essence of the procedure hereby described, may be varied for the purpose of this invention.

I claim:

1. A discharge printing process for textile stock dyed with indigo blue, comprising the consecutive steps of (a) applying to the dyed textile stock a printing paste consisting essentially of (1) water, (2) between 12 and 50% of a thickener, (3) a reducing agent or oxidizing agent, (4) a bleaching agent or dye resistant to instant discharge process and (5) as an indigo dyestuff remover, the disodium or calcium salt of p,p'-di-sulfonated dimethylphenylbenzyl ammonium chloride; (b) drying the printed dyed textile stock at between 100° and 126°; (c) developing the stock in a bath consisting of a second removing agent in the presence of a strong dispersing agent in the amount of between 5 and 17 g per liter, and (d) washing the stock with water.

2. The process according to claim 1, wherein the reducing agent comprises 50 to 280 g of sodium hydrosulfite per kg of paste, the thickener is dextrinated starch or etherized starch; the removing agent in the developing bath is hot sodium hydroxide in the proportion of 8 to 19 g per liter; and the dispersing agent is sodium dimethylmethylate and or sodium dimethylmethanesulfonate.

3. The process according to claim 1, wherein the oxidizing agent comprises between 15 and 46 g of potassium dichromate per kg of paste and between 6 and 13 g of caustic soda per kg of paste; the thickener is etherized starch; and the removing agent in the developing bath is a mixture of oxalic acid and sulfuric acid at a temperature of between 35° and 55° C. in the proportions of between 34 and 70 g/liter of 66° Bé sulfuric acid and 30–60 g/liter of oxalic acid.

* * * * *